US006394587B1

(12) United States Patent
Aizawa et al.

(10) Patent No.: US 6,394,587 B1
(45) Date of Patent: May 28, 2002

(54) IMAGE FORMING DEVICE

(75) Inventors: Masahiro Aizawa, Takatsuki; Yoshitaka Kitaoka, Osaka; Akira Kumon, Katano; Akira Fukano, Ikoma, all of (JP)

(73) Assignees: Matsushita Electric Industrial Co., Ltd., Osaka (JP); Array AB Publ., Vaestra Froelunda (SE)

( * ) Notice: Subject to any disclaimer, the term of this patent is extended or adjusted under 35 U.S.C. 154(b) by 0 days.

(21) Appl. No.: 09/830,759

(22) PCT Filed: Oct. 28, 1999

(86) PCT No.: PCT/JP99/06003

§ 371 (c)(1),
(2), (4) Date: Jun. 26, 2001

(87) PCT Pub. No.: WO00/24585

PCT Pub. Date: May 4, 2000

(30) Foreign Application Priority Data

| | | |
|---|---|---|
| Oct. 28, 1998 | (JP) | 10-306871 |
| Oct. 28, 1998 | (JP) | 10-306872 |
| Nov. 4, 1998 | (JP) | 10-312707 |

(51) Int. Cl.[7] ..... B41J 02/06
(52) U.S. Cl. ..... 347/55
(58) Field of Search ..... 347/55, 151, 120, 347/141, 154, 103, 123, 111, 159, 127, 128, 131, 125, 158; 399/271, 290, 292, 293, 294, 295

(56) References Cited

FOREIGN PATENT DOCUMENTS

| | | |
|---|---|---|
| JP | 55-55878 | 4/1980 |
| JP | 2-120059 | 5/1990 |
| JP | 4-142952 | 5/1992 |
| JP | 4-173355 | 6/1992 |
| JP | 4-329156 | 11/1992 |
| JP | 6-246957 | 9/1994 |
| JP | 6-246958 | 9/1994 |
| JP | 6-316101 | 11/1994 |
| JP | 7-40578 | 2/1995 |
| JP | 7-68830 | 3/1995 |
| JP | 7-068831 | 3/1995 |
| JP | 7-214815 | 8/1995 |
| JP | 6-289097 | 5/1996 |
| JP | 8-118706 | 5/1996 |
| JP | 8-104022 | 12/1996 |
| JP | 9-314891 | 12/1997 |
| JP | 10-16279 | 1/1998 |
| JP | 10-235925 | 9/1998 |
| JP | 10-337897 | 12/1998 |

*Primary Examiner*—Raquel Yvette Gordon
(74) *Attorney, Agent, or Firm*—Jordan and Hamburg LLP

(57) ABSTRACT

An image forming device includes a toner carrier (1) for holding and conveying charged toner (2), and a toner passage controller (3) including a plurality of holes (4) through which toner (2) is passed and control electrodes (10) disposed surrounding the holes. The control of passing of the toner (2) through the holes is effected by applying voltage to the control electrodes in accordance with image signals. The holes (4) have an elongated shape, with the length along a direction in which the toner carrier (1) moves being longer than the width orthogonal to the lengthwise direction, so that the consumption areas of toner (2) on the toner carrier (1) do not interfere with each other while the open area of the holes (4) is sufficiently secured.

20 Claims, 15 Drawing Sheets

IMAGE FORMING DEVICE

TECHNICAL FIELD

The present invention relates to an image forming device such as a copier, facsimile, printer or the like. More particularly, the invention relates to an image forming device wherein toner is caused to travel from a toner carrier toward an electrode disposed on the backside of an image receiving member and be deposited on the image receiving member thereby effecting image formation, with the toner deposition being controlled by a toner passage controller based on image signals.

BACKGROUND ART

In recent years, advances in the performance of personal computers and in network technology have brought about a strong demand for printers and copiers with high processing capabilities that can handle a large amount of documents including color documents. However, image forming devices that can output black and white and color documents with satisfactorily high quality and processing speed are still under development.

An image forming technology known as a "toner jet™" method includes causing toner to fly onto an image receiving member such as a recording sheet or an image carrying belt by the action of an electric field.

Image forming devices of this type are disclosed, for example, in Japanese Published Examined Patent Application No. 44-26333, U.S. Pat. No. 3,689,935 (Japanese Published Examined Patent Application No. 60-20747), Japanese Published Unexamined Patent Application No. 9-500842. As one example of these devices, the one disclosed in Japanese Laid-open Patent Application No. 10-100780 will be described with reference to FIG. 17.

In FIG. 17, reference numeral 31 denotes a grounded toner carrier for conveying charged toner. A control blade 32 is provided for charging toner and adjusting same in one to three layers on the toner carrier 31. Reference numeral 33 denotes a supply roller for supplying toner to the toner carrier 31 and charging the toner. Reference numeral 34 denotes a toner passage controller, in which toner passage holes 35 are formed, surrounded by control electrodes 36. Voltage is applied from a control power source 37 to the control electrodes 36 in accordance with image signals. Reference numerals 38 and 39 represent a backside electrode and a power source for same, respectively. An image receiving member 40 such as recording paper is conveyed on the backside electrode 38.

With the supply roller 33 and the toner carrier 31 in operation, a uniform toner layer is formed on the toner carrier 31 by the control blade 32. In this state, voltage is applied to the backside electrode 38, and while the image receiving member 40 is moved, voltage is applied to the control electrodes 36 in synchronism therewith based on image signals, from the control power source 37, which is, for example, a driving IC or the like. Thereupon, the toner on the toner carrier 31 passes through the toner passage holes 35 in accordance with the image signals and adheres to the image receiving member 40, whereby a desired image is formed on the image receiving member 40.

In order to form a fine image of for example 600 pi (i.e., at a density of 600 dots per inch) on the entire surface of the image receiving member 40, it is necessary to line up the toner passage holes 35 in the toner passage controller 34 at a corresponding pitch. Since this is obviously not achieved in a single row, the toner passage holes 35 and the control electrodes 36 are lined up in a large number of rows (eight rows in the example), as shown in FIG. 18. The toner passage holes 35 and the control electrodes 36 are both circular, and connection electrodes leading to the control electrodes 36 extend toward both sides with respect to the moving direction of the toner carrier 31 so as to avoid interference between them. The connection electrodes are connected to the leads of corresponding driving ICs for outputting control voltage.

Such construction has the problem of high cost in view of the large number of toner passage holes 35 and corresponding driving ICs. Moreover, there is the problem known as white line noise (hereinafter referred to as "WLN") wherein grey or white streaks are produced in the image, because most of the toner on the toner carrier 31 is consumed at the first row of the toner passage holes 35 and the toner density decreases in the direction in which the toner passage holes 35 are arranged, i.e., in the direction perpendicular to the moving direction of the toner carrier 31.

In view of these problems, it has been proposed to provide deflection electrodes 41*a*, 41*b* in addition to the control electrodes 36 around the toner passage holes 35 as shown in FIG. 19 so as to deflect the flying toner, thereby enabling a plurality of dots to be deposited through one toner passage hole 35 ("New multiplexing method makes TonerJet even more low cost manufacturing" by Ove Larson, Journal of Electrophotography, Vol. 36, No. 2, p. 46–49, 1997).

Referring to FIGS. 19 and 20, below the control electrodes 36 shown in FIG. 20A, deflection electrodes 41a, 41*b* are arranged in pairs on right and left sides of the toner passage holes 35 as shown in FIG. 20B. Voltage is selectively applied to the deflection electrode 41*a*, 41*b*, or to both of them, so as to determine toner landing positions 42*a* to 42*c* as shown in FIG. 19B. Voltage application to the deflection electrode 41*a*, 41*b*, or to both of them is switched over as the image receiving member 40 is moved. Accordingly, the deflection electrodes 41*a*, 41*b* are arranged at an angle such that tan θ is ⅓ (18.4) with respect to the center lines through the toner passage holes 35 as shown in FIG. 20B to compensate for the movement of the image receiving member 40. Voltage is applied first to the deflection electrode 41*a* or 41*b* which is offset toward the upstream side with respect to the travelling direction of the image receiving member 40.

With this construction, the pitch P with which the toner passage holes 35 are arranged is 254 μm, ensuring sufficient aperture area of the toner passage holes 35, whereby the control of flying toner is performed reliably. The toner passage holes 35 need be provided only in two rows as shown in the drawings for forming an image of 600 dpi, leading to a considerable reduction in cost.

The device shown in FIG. 17 adopts a structure wherein the image receiving member 40 is a recording sheet or the like, on which an image is formed directly. In the case of forming a color image, it is difficult to synchronize the timing of image formation of various colors because of the variations in the conveyance of the recording paper, because of which image quality can decrease. Therefore, in some cases it is preferable to use an intermediate image carrying belt as the image receiving member 40 and to transfer the image formed thereon onto the recording paper or the like, as disclosed in Japanese Laid-open Patent Application No. 10-100780.

Referreing now to FIG. 21, reference numeral 43 denotes an endless image carrying belt serving as the image receiving member 40, made of a resin film of about $10^{10}\Omega$/cm resistance into which a conductive filler has been dispersed, and wound around a pair of two rollers 44*a,* 44*b.* Reference numeral 45 denotes a pick-up roller for feeding recording sheets 46 one by one from a paper supply tray. Reference numeral 47 represents a timing roller for synchronizing the supplied recording paper 46 with an image position. Reference numeral 48 represents a transfer roller for transferring a toner image formed on the image carrying belt 43 onto the recording paper 46. The transfer roller 48 is pressed against the roller 44a with the image carrying belt 43 interposed therebetween and voltage is applied thereto for the transfer of images. Reference numeral 49 denotes a fixing device for fixing the toner image transferred onto the recording paper 46 by applying heat and pressure thereto.

In such image forming device wherein the toner passage holes 35 are provided in two rows as shown in FIG. 20, most of the toner is consumed at the toner passage holes 35 on the upstream side with respect to the moving direction of the toner carrier 31, so that toner held on the toner carrier 31 has been decreased by the time it reaches the toner passage holes 35 on the downstream side. Thus, the above-described problem of "WLN" can easily occur. This could be prevented if the diameter of the toner passage holes 35 is decreased to minimum so that the areas where toner on the toner carrier 31 is consumed do not interfere with each other. On the other hand, this would cause clogging of toner in the toner passage holes 35. Thus, with regard to the hole diameter of the toner passage holes 35, there is a trade-off between the prevention of WLN and of toner clogging.

In the image forming device described above, particularly when the toner passage holes 35 are arranged in two rows as shown in FIG. 20, with connection electrodes 36*a* extending toward the upstream side and with connection electrodes 36*b* extending toward the downstream side, the problem of "WLN" can occur for the following reason: The control voltage applied to the connection electrodes 36*a* from the driving ICs on the upstream side causes the toner held on the toner carrier 31 to fly repeatedly to and from the connection electrodes 36*a*. Thereby, part of the toner on the toner carrier 31 is gathered to the regions opposite the connection electrodes 36*a*. As a result, toner is passed in a greater amount through the toner passage holes 35 on the upstream side, and the amount of toner flying through the toner passage holes 35 on the downstream side is decreased accordingly.

This problem occurs even when the toner passage holes 35 are arranged in one row, if the connection electrodes extend alternately toward the upstream side and the downstream side.

Moreover, in the above-described image forming device wherein the toner carrier 31 is a roller, if the toner passage holes 35 are formed in a plurality of rows in the moving direction of the toner carrier 31, the distance between the toner carrier 31 and the toner passage holes 35 differs from row to row, leading to a difference in the toner amount deposited on the recording paper 46 from row to row, resulting in detrioration of image quality.

In light of the above-described problems of the prior art, it is an object of the present invention to provide an image forming device in which white line noise and toner clogging are eliminated.

It is another object of the invention to provide an image forming device in which white line noise caused by electric fields is eliminated.

It is yet another object of the invention to provide an image forming device in which deterioration of image quality due to differences in the amount of toner applied from row to row of toner passage holes is prevented.

DISCLOSURE OF THE INVENTION

An image forming device according to one aspect of the present invention includes a toner carrier for holding and conveying charged toner, and a toner passage controller including a plurality of holes through which toner is passed and control electrodes disposed surrounding the holes. The control of passing of the toner through the holes is effected by applying voltage to the control electrodes in accordance with image signals. The holes are formed oblong in shape, with the length along a direction in which the toner carrier moves being longer than the width orthogonal to the lengthwise direction. Thereby, the consumption areas of toner on the toner carrier do not interfere with each other and the problem of white line noise is eliminated. Since the open area of the holes is sufficiently secured by the large length, toner clogging is reliably prevented.

The toner passage holes may substantially be rectangular, but preferably be elliptic.

The holes should preferably have the dimensions specified as $0.65 \leqq W/L \leqq 0.90$, where L is the length of the holes in a direction in which the toner carrier moves, and W is the width in a direction orthogonal to the lengthwise direction.

The width W should be more than 65% of the length L in order to secure density of dot image formed on the image receiving member, as well as to prevent toner clogging in the holes. If the width W is less than 65% of the length L, the aperture area of the holes will be too small in view of the limitation on enlargement of the length L, whereby it will become difficult to secure sufficient amount of toner, leading to a decrease in the dot image density and causing toner clogging. If the width W exceeds 90% of the length L, then the effects of preventing the problem of white line noise will not be achieved.

The width W and the length L are most preferably set as follows in consideration of dot image density and prevention of toner clogging: $0.70 \leqq W/L \leqq 0.80$.

Further, provided that the mean particle size of toner used in the image forming device is about 6 to 15 $\mu$m, the holes should have an open area S determined as follows:

$5000\ \mu m^2 \leqq S \leqq 7000\ \mu m^2$ $W \geqq 70\ \mu m$.

The holes through which toner passes should have a minimum curvature radius at the periphery thereof which is more than the mean particle size of the toner. In this way, toner build-up in the corners of the holes which leads to toner clogging is prevented. The average particle size of toner is about 6 to 15 $\mu$m, and particularly about 8 $\mu$m.

The holes may have an inner wall surface having a surface roughness which is less than the mean particle size of the additives added to the toner, so that toner can hardly adhere to the inner wall of the holes for preventing toner clogging. The mean particle size of the additives is usually about 0.1 to 0.5 $\mu$m. Forming of the holes having such surface roughness can be achieved by a drilling process using an excimer laser or a punch. Alternatively, such holes may be formed by first drilling the holes using a YAG laser, $CO_2$ laser or the like, and by performing surface treatment such as etching or the like.

The inner wall surface of the holes may be made of a material having low affinity with the toner, so that toner can hardly adhere to the inner wall of the holes for preventing toner clogging. Specifically, the inner wall of the holes can be coated with a fluoride-based resin or a silicon-based resin or the like.

The inner wall surface of the holes may be coated with a material having low affinity with the toner and a melting point which is lower than that of the material forming the toner passage controller, so that such coating can be provided easily by dipping or spraying.

The holes may be formed with minute protrusions at the peripheral edge thereof on the side of the toner carrier, so as to prevent toner depposited around the holes from falling into the holes and accumulating therein, clogging the holes.

Such minute protrusions may be simply provided by employing a material having high ductility for the toner passage controller and drilling the holes by punching, whereby burrs are created which can serve as such protrusions.

The holes are formed in an elongated shape, with a length thereof along a direction in which the toner carrier moves being larger than a width thereof along a direction orthogonal to the lengthwise direction, and further, the toner passage controller is given larger tension in the moving direction of the toner carrier than in the direction orthogonal thereto. Thereby, the rectangular or elliptic holes are prevented from being deformed by the tension applied to the toner passage controller. Deterioration of image quality caused by changes in the aperture area of the holes is thus prevented.

The control electrodes surrounding the holes may have a larger width in a direction along a longer diameter of the holes than a width thereof in a direction along a shorter diameter of the holes. In this way, toner is more readily collected to both longitudinal ends of the oblong holes while the toner amount on the lateral sides of the holes is decreased, whereby bridging of toner across the shorter diameter of the holes and clogging caused thereby are prevented.

The control electrodes may have a rough surface in a portion upstream of the holes in a direction in which the toner carrier moves. Thereby, electric fields are concentrated above the electrodes on the upstream side of the holes, activating the movement of the toner held on the toner carrier. Agglomeration and dispersion of toner are thereby repeated and toner density is made uniform.

The holes may be formed in a plurality of rows with a certain pitch space along a direction orthogonal to a direction in which the toner carrier moves, the holes and the control electrodes on a downstream side in the moving direction of the toner carrier having a diameter larger than that of the holes and the control electrodes on an upstream side. In this way, the amount of toner supplied through the holes on the downstream side is increased, making the toner density uniform, whereby image quality is enhanced.

An image forming device according to another aspect of the present invention includes: a toner carrier for holding and conveying charged toner; a toner passage controller including a plurality of holes through which toner is passed and a plurality of control electrodes surrounding the holes, control of passing of the toner through the holes being effected by applying voltage to the control electrodes in accordance with input image signals, the plurality of holes being formed in two rows in a zigzag fashion on an upstream side and a downstream side along a direction orthogonal to a direction in which the toner carrier moves; a plurality of connection electrodes respectively connected to each of the control electrodes for applying voltage thereto in accordance with the image signals, one group of connection electrodes connected to the control electrodes surrounding the holes on the upstream side row extending toward upstream side, while the other group of connection electrodes connected to the control electrodes surrounding the holes on the downstream side row extending toward downstream side; a plurality of dummy electrodes respectively connected to each of the control electrodes surrounding the holes on the downstream side row such as to extend toward upstream side; an image receiving member on which toner is deposited; and a backside electrode for attracting toner thereto disposed on the backside of the image receiving member.

According to the invention, the connection electrodes for the control electrodes provided in two rows and their respective driving ICs can be arranged with enough space on both upstream and downstream sides. The dummy electrodes are extended toward the upstream side from the control electrodes in the downstream side row in order to create electric fields whereby the toner amount supplied from the holes on the upstream and downstream sides is made uniform, eliminating the problem of white line noise. Also, the dummy electrodes cause the toner to repeatedly fly to and from the toner passage controller whereby the toner density is made uniform. Thus toner is efficiently and uniformly supplied from the toner carrier to the holes.

The plurality of holes may be arranged in a single or a plurality of rows along a direction orthogonal to a direction in which the toner carrier moves, and a plurality of electrodes may respectively be connected to each of the control electrodes such as to extend toward an upstream side in the moving direction of the toner carrier. The effects described above will likewise be achieved. The driving ICs for all of the control electrodes may be disposed on the upstream side, with all of the connection electrodes being extended toward the upstream side. Alternatively, part of the control electrodes may have their driving ICs on the downstream side, with their connection electrodes being extended toward the downstream side, while their dummy electrodes are extended toward the upstream side.

Alternatively, the plurality of holes may be arranged in a single or a plurality of rows along a direction orthogonal to a direction in which the toner carrier moves; and a plurality of connection electrodes may respectively be connected to each of the control electrodes for applying voltage thereto in accordance with the image signals such as to extend alternately toward an upstream side and a downstream side in the moving direction of the toner carrier; and a plurality of dummy electrodes may respectively be connected to the control electrodes from which the connect electrodes extend toward the downstream side such as to extend toward the upstream side.

The control electrodes may have a rough surface in a portion upstream of the holes in a direction in which the toner carrier moves. Thereby, electric fields are concentrated above the electrodes on the upstream side of the holes, activating the movement of the toner held on the toner carrier. Agglomeration and dispersion of toner are thereby repeated and toner density is made uniform.

The holes may be formed in a plurality of rows with a certain pitch space along a direction orthogonal to a direction in which the toner carrier moves, the holes and the control electrodes on a downstream side in the moving direction of the toner carrier having a diameter larger than that of the holes and the control electrodes on an upstream side. In this way, the amount of toner supplied through the holes on the downstream side is increased, making the toner density uniform, whereby image quality is enhanced.

An image forming device according to yet another aspect of the present invention includes: a toner carrier for holding and conveying charged toner; a toner passage controller including a plurality of holes through which toner is passed and a plurality of control electrodes surrounding the holes, control of passing of the toner through the holes being effected by applying voltage to the control electrodes in accordance with input image signals, the plurality of holes being arranged along a direction orthogonal to a direction in which the toner carrier moves; a plurality of deflection electrodes provided on both sides of each holes; an image receiving member on which toner is deposited; and a backside electrode for attracting toner thereto disposed on the backside of the image receiving member. According to this construction, the holes are arranged in one row, while toner is caused to be deposited on a plurality of points through a single toner passage hole by means of the deflection electrodes. Accordingly, the toner passage holes are arranged with a practicable pitch space, enabling a fine image to be formed. The single row arrangement of toner passage holes makes toner supply under constant conditions possible, whereby image quality is enhanced.

The deflection electrodes include longitudinal electrodes extending along the moving direction of the toner carrier and lateral electrodes extending perpendicular thereto from both sides of the longitudinal electrodes alternately at positions on an upstream side and a downstream side of each of the holes, so that one lateral electrode is shared by two adjacent holes. In this way, the deflection electrodes can be constructed simply and the pitch space between adjacent holes be made small.

BEST MODE FOR CARRYING OUT THE INVENTION

An image forming device according to one embodiment of the invention will be hereinafter described with reference to FIGS. 1 to 12.

Figures 2A, 2B, 2C:
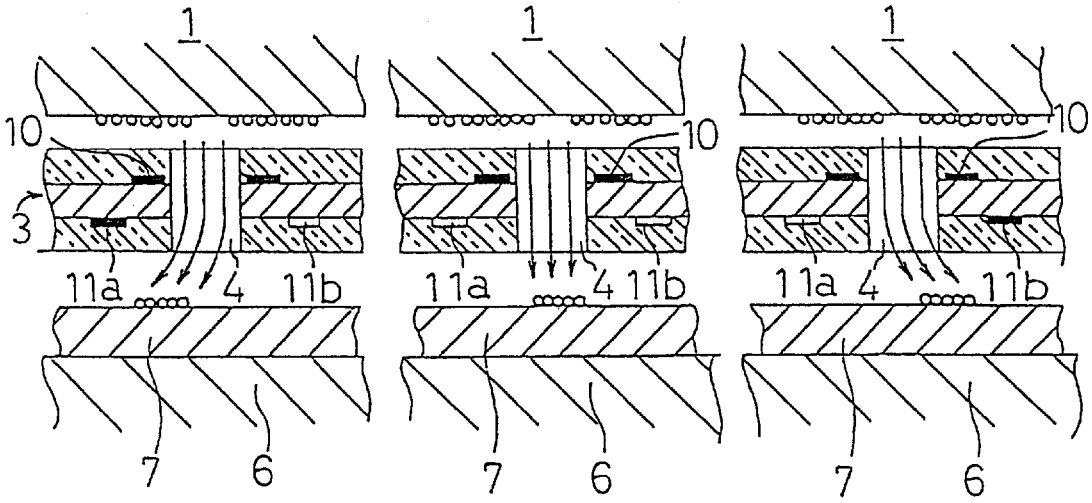
FIGS. 2A to 2C are vertical cross-sectional side elevation views showing three operating states in a toner passage hole in this embodiment.
Figure 3:
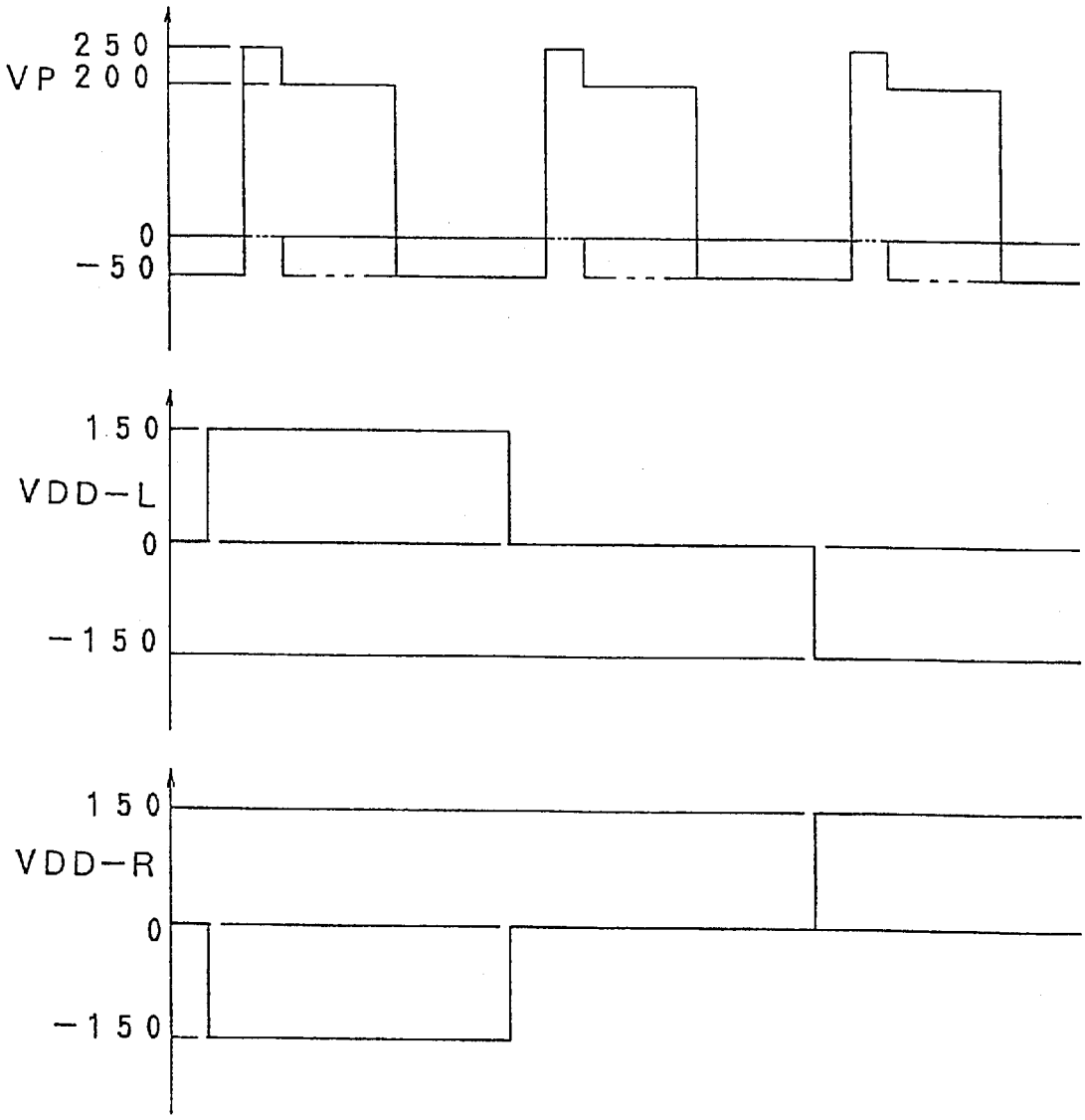
FIG. 3 is a timing chart for applying voltage to the electrodes and deflection electrodes in this embodiment.
Figure 4A:
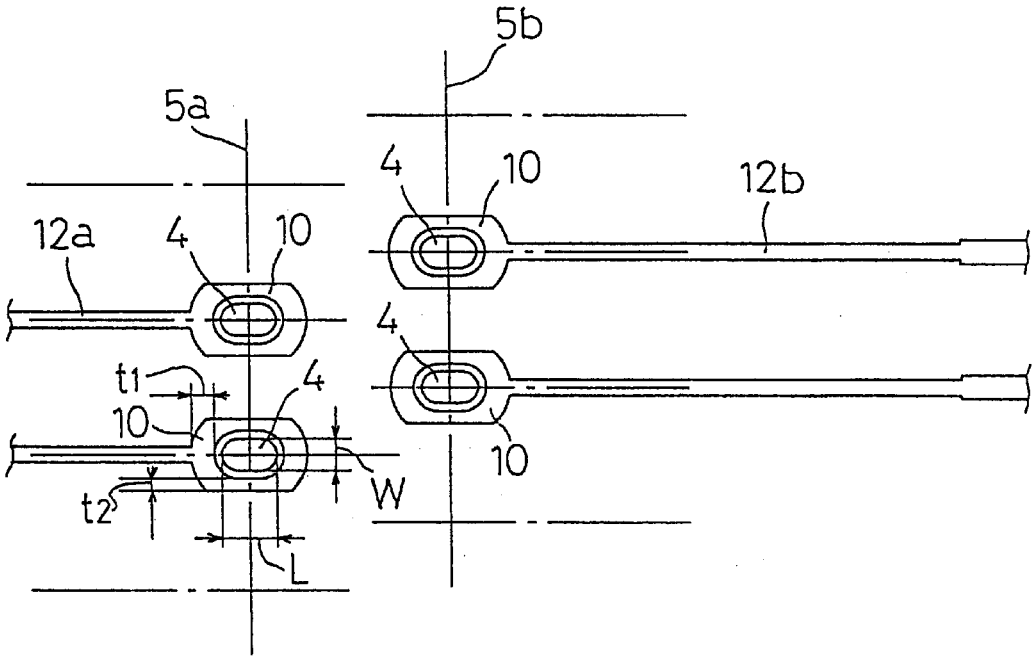
FIGS. 4A and 4B are top plan views showing the arrangement of the electrodes and deflection electrodes, respectively.
Figure 4B:
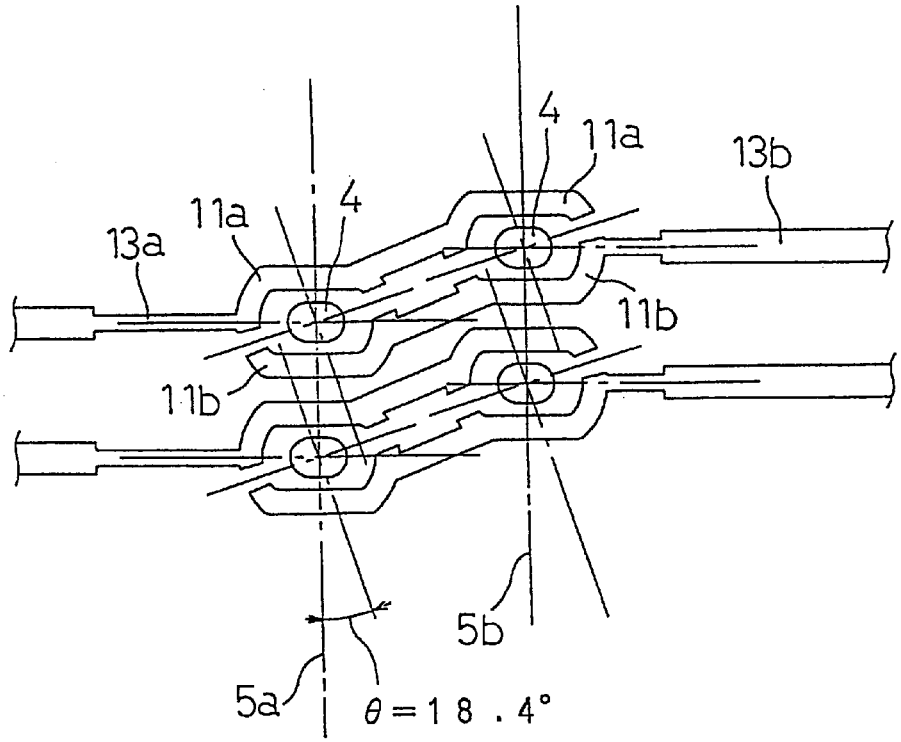

In FIGS. 1 to 6, reference numeral 1 represents a toner carrier for carrying and conveying charged toner 2. The toner carrier 1 is composed of a grounded rotatable sleeve, and as its potential is ground potential, the negatively charged toner 2 is carried thereon in one to three thin layers. Reference numeral 3 represents a toner passage controller made of a flexible printed board having a width corresponding to the effective width of the toner carrier 1. As shown in FIG. 4, the toner passage controller 3 is formed with a large number of toner passage holes 4 in rows at a pitch space of 254 $\mu$m in a direction perpendicular to the moving direction of the toner carrier 1. These toner passage holes 4 are formed as two parallel rows 5*a*, 5*b*, being offset in the direction in which they are arranged in a zig-zag fashion.

A backside electrode 6 is arranged opposite to the toner carrier 1 with the toner passage controller 3 interposed therebetween. An image receiving member 7 such as a recording sheet or an image carrying belt is carried on the backside electrode 6 and conveyed along a path between this and the toner passage controller 3. The upstream side row 5*a* of the toner passage holes 4 is positioned about 300 to 500 $\mu$m away toward the downstream side with respect to the moving direction of the toner carrier 1 from the vertical line c extending from the center of the toner carrier 1 to the backside electrode 6. The downstream side row 5*b* of the toner passage holes 4 is positioned 300 to 400 $\mu$m further away toward the downstream side.

Figure 1:
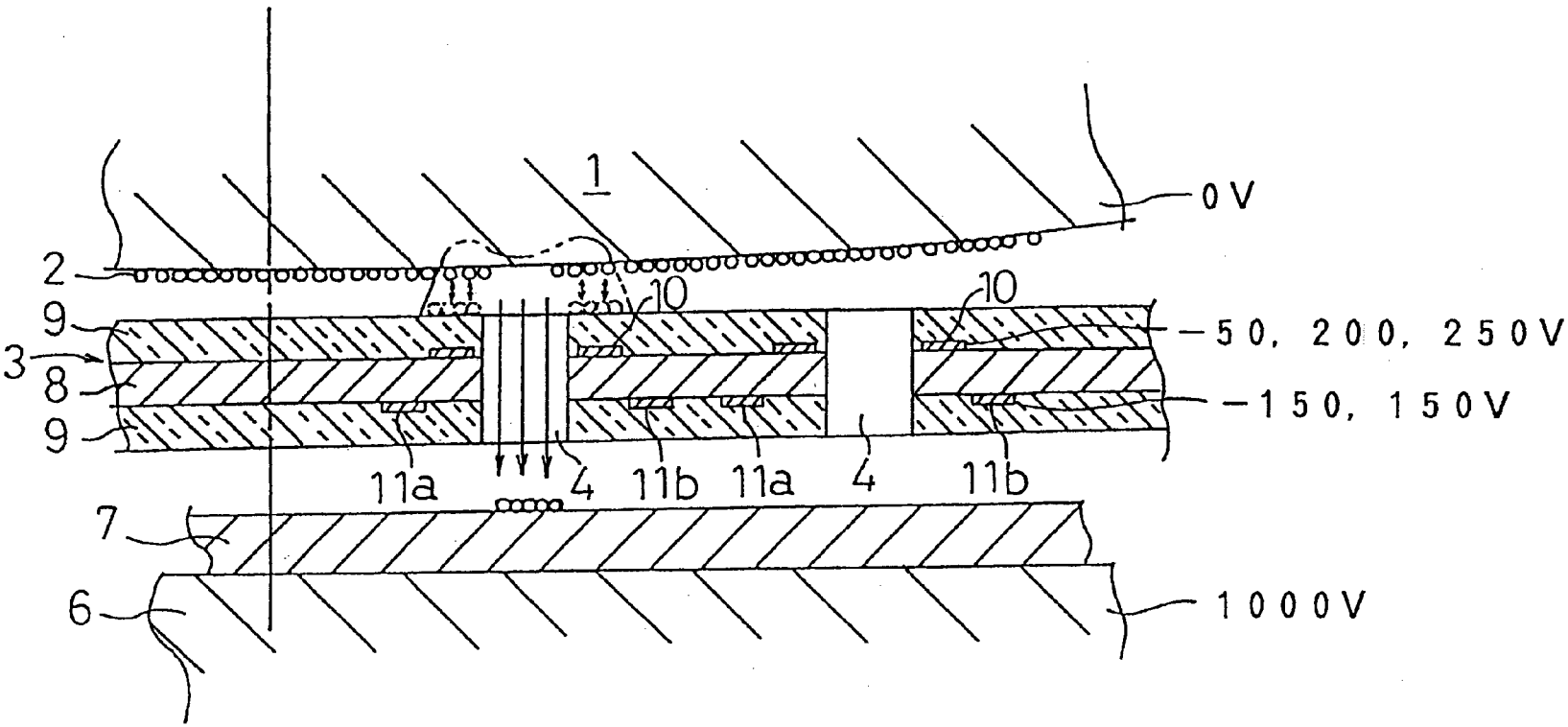
FIG. 1 is a vertical cross-sectional elevation of the principal parts of an image forming device according to one embodiment of the invention.

The toner passage controller 3 is composed of a three-layer polyimide-based resin film including a main film 8 of about 50 $\mu$m thickness, and two cover films 9 of about 10 to 30 $\mu$m thickness bonded to both sides of the main film 8 with an adhesive layer of about 10 to 15 $\mu$m thickness, as shown in FIG. 1. The material, dimensions and the number of layers of the films should not be limited to the above-described example and may be varied as required.

On the upper surface of the main film 8 are formed control electrodes 10 such as to surround the entire periphery of the toner passage holes 4, while on the lower surface of the main film 8 are formed a pair of deflection electrodes 11*a,* 11*b* such as to surround the toner passage holes 4 from both sides thereof. These electrodes 10, 11*a,* 11*b* are made of Cu films of about 8 to 20 μm thickness patterned on the main film 8. The deflection electrodes 11*a,* 11*b* in pairs are arranged opposite each other and, when viewed from above, inclined with respect to the center lines through the rows 5*a* or 5*b* at an angle of tanθ/3, i.e., 18.4.

As shown in FIG. 4, connection electrodes 12*a,* 12*b* extend respectively from the control electrodes 10 of the upstream side rows 5*a* and of the downstream side rows 5*b* toward opposite directions to connect the control electrodes 10 to their respective driving ICs. From the control electrodes 10 of the upstream side rows 5*a* extend the connection electrodes 12*a* toward the upstream side with respect to the moving direction of the toner carrier 1, while the connection electrodes 12*b* extend toward the downstream side. The deflection electrodes 11*a*, 11*b* are provided in pairs for each of the toner passage hole 4 as described above, the deflection electrodes 11*a* located on the same side of two adjacent toner passage holes 4 being paired and mutually connected. Likewise, the deflection electrodes 11*b* located on the opposite side are paired and mutually connected. Connection electrodes 13*a,* 13*b* extend respectively from the deflection electrodes 11*a,* 11*b* to connect them to their respective driving ICs, the connection electrodes 13*a* extending toward the upstream side with respect to the moving direction of the toner carrier 1, and the connection electrodes 13*b* extending toward the downstream side. The connection electrodes 12*b* may also be extended toward the upstream side in the moving direction of the toner carrier 1, in which case the surface of the electrodes 10 and the connection electrodes 12*a,* 12*b* located further toward the upstream side in the moving direction of the toner carrier 1 than the toner passage holes 4 may be roughened.

The voltage Vp applied to the control electrodes 10 is switched for example between −50V, 200V, and 250V, and the voltage $V_{DD-L}$ and $V_{DD-R}$ applied to the deflection electrodes 11*a*, 11*b* is switched for example between 150V, 0V and −150V, with the timing shown in FIG. 3. The voltage applied to the backside electrode 6 is set to 1000V, for example.

Referring to FIG. 3, initially, voltage of −50V is applied to the control electrodes 10 while no voltage is applied to the deflection electrodes 11*a,* 11*b,* so that the toner 2 held on the toner carrier 1 is not affected by the electric field created by the backside electrode 6. Then, while applying +150V voltage to the left deflection electrode 11*a* and −150V to the right deflection electrode 11*b,* a voltage of 250V is applied to the control electrodes 10, the voltage then being decreased to 200V, so as to remove the negatively charged toner 2 attracted on the toner carrier 1 and deflect same toward the left side. Thereby, the toner 2 passes through the toner passage hole 4 as being offset toward left as shown in FIG. 2A, and lands on the image receiving member 7 at a position about 40 μm shifted to the left. Next, while no voltage is applied to the right and left deflection electrodes 11*a,* 11*b,* voltage as noted above is applied to the control electrodes 10. Thereby, the toner 2 is applied to the image receiving member 7 at a position opposite the toner passage holes 4, as shown in FIG. 2B. Next, while applying −150V voltage to the left deflection electrode 11*a* and +150V voltage to the right deflection electrode 11*b,* voltage is applied to the control electrodes 10 as described above, so as to deflect the negatively charged toner 2 toward the right side. Thereby, the toner 2 is applied to the image receiving member 7 at a position about 40 μm shifted to the right side, as shown in FIG. 2C. Thus voltage applied to the control electrodes 10 and the deflection electrodes 11*a*, 11*b* is switched over so as to enable toner to be deposited to three different points, while passing through one toner passage hole 4.

When effecting control not to allow the toner 2 to pass through the toner passage holes 4, voltage applied to the control electrode 10 is changed as shown by the imaginary line from −50V to 0V. This is carried out in order to cause part of the toner which is charged to the opposite polarity (positive) to return toward the negatively charged toner 2 on the toner carrier 1. More specifically, the toner contains positively charged particles which are deposited on the toner passage controller 3 above the control electrodes 10. These positively charged particles attract negatively charged toner 2, so that toner is apt to be deposited around the toner passage holes 4 causing the clogging thereof. The above described control of voltage applied to the electrodes 10 is performed to prevent this clogging of the toner passage holes 4.

As has been mentioned above, the control electrodes 10 and the connection electrodes 12*a*, 12*b* may have a roughened surface at portions on the upstream side of the toner passage holes 4 in the moving direction of the toner carrier 1. This is because such will activate the motion of the toner 2 on the upstream side of the toner passage holes 4 by the action of electric fields concentrating on these electrodes. Thereby, agglomeration and dispersion of the toner 2 are repeated, so that the toner is more densely and uniformly distributed.

Figure 5A:
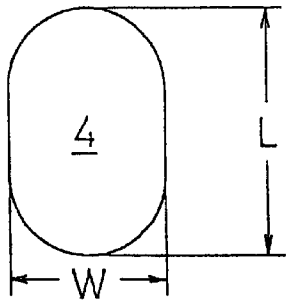
FIG. 5A is a top view thereof.

The toner passage hole 4 in this embodiment has an elliptic shape when viewed from above as shown in FIG. 4 and FIG. 5A, its length L in the moving direction of the toner carrier 1 being longer than its width W in the direction perpendicular thereto. In the illustrated example, the length L is set to about 100 μm while the width W is set to about 70 to 80 μm. The width W may be set to any value in a range of about 65 to 90 μm. Meanwhile, the control electrode 10 surronding the toner passage hole 4 has a width $t_1$ in a direction along the longer diameter of the toner passage hole set to be larger than a width $t_2$ in a direction along the shorter diameter of the toner passage hole. The open area of the toner passage holes should preferably be set to about 5000 to 7000 $\mu m^2$, with the width W being at least 70 μm.

Figure 5B:
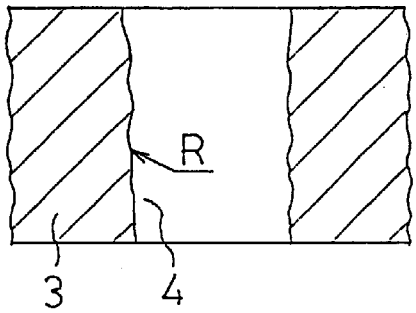
FIG. 5B is a vertical cross-section thereof, showing a toner passage hole in this embodiment.
Figure 6:
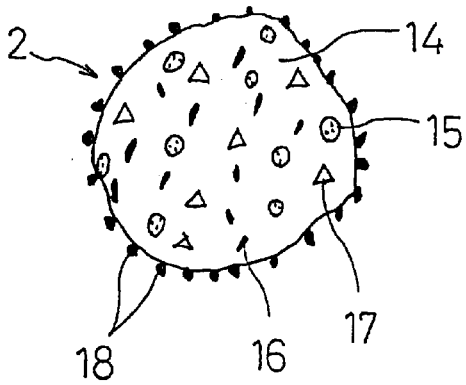
FIG. 6 illustrates the structure of the toner in this embodiment.

The inner wall surface of the toner passage hole 4 has a surface roughness R which is less than the average particle size of the additives to the toner 2, as shown in FIG. 5B. The toner 2 includes a base material 14 made of a synthetic resin such as polyester or styrene acryl, and a charge control agent 15 containing an electron accepting material (for negative charging) and an electron donating material (for positive charging), a pigment 16, and a release agent 17 for preventing offset, such as polypropylene or wax, all these being dispersed in the base material 14. The toner has a granular shape with an average particle size of 6 to 15 μm, and an additive 18 such as $SiO_2$, $Al_2O_3$ or $TiO_2$ with an average particle size of 0.1 to 0.5 μm is further applied to its outer surface to ensure flowability. The surface roughness R of the inner wall of the toner passage holes 4 is set 0.1 to 0.5 μm or less corresponding to the average particle size of the additive 18. Drilling of such holes having a specified inner surface rouchness R can be achieved by processing with an excimer laser or punching. Alternatively, holes may be first drilled using a YAG laser or $CO_2$ laser, and thereafter subjected to appropriate surface treatment such as etching.

According to the image forming device of this embodiment, while the toner passage holes 4 are provided in a plurality of rows 5*a,* 5*b,* they are formed in an elliptic shape, having a smaller width W. Therefore, the toner consumption areas on the toner carrier 1 corresponding to each of the toner passage holes 4 hardly interfere with each other, thus preventing the problem of white line noise. Also, the open area of the toner passage holes 4 is sufficiently secured due to the large length L of the holes, thereby preventing toner clogging of the holes. The control electrodes 10 surrounding the toner passage holes 4 are capable of attracting more toner in parts along the longer diameter of the holes than in parts along the shorter diameter of the holes, due to their width $t_1$ in the longer diameter direction of the toner passage holes being larger than the width $t_2$ in the shorter diameter direction. Accordingly, bridging of toner in the shorter diameter direction of the holes is much less likely to occur. Moreover, toner can hardly adhere to the inner wall of the toner passage holes 4 because of its surface roughness R being set less than the average particle size of the additives 18 of the toner 2, whereby clogging of the toner passage holes is reliably prevented.

Figure 7:
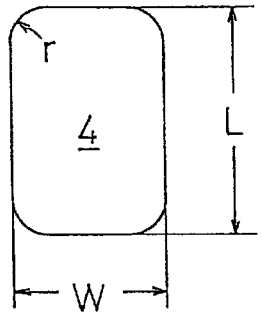
FIG. 7 is a top view showing another example of the shape of a toner passage hole in this embodiment.
Figure 8:
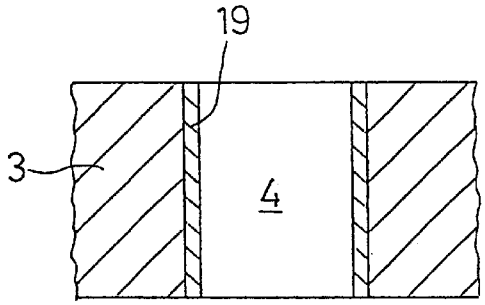
FIG. 8 is a vertical cross-section showing another example of the structure of a toner passage hole in this embodiment.

The toner passage holes 4 may also be formed in a rectangular shape as shown in FIG. 7, having rounded corners with a minimum curvature radius r being set more than the average particle size of the toner 2, for example, at least 6 to 15 $\mu$m. In this way, toner 2 can hardly build up in the corners of the toner passage holes 4, and clogging of the holes is prevented.

As an alternative, the toner passage hole 4 may be provided with a coating 19 of fluorine-based resin or silicon-based resin or any other material having low affinity to the toner 2 on the inner wall thereof, so as to prevent toner 2 from sticking to the inner wall of the toner passage holes 4. The material for the coating 19 may be selected from those having a melting point lower than that of the polyimide resin forming the base material of the toner passage controller 3 as mentioned above, so that the coating 19 is readily formed by dipping or spraying. The coating 19 may be formed continuously onto the surface of the toner passage controller 3.

Figure 9:
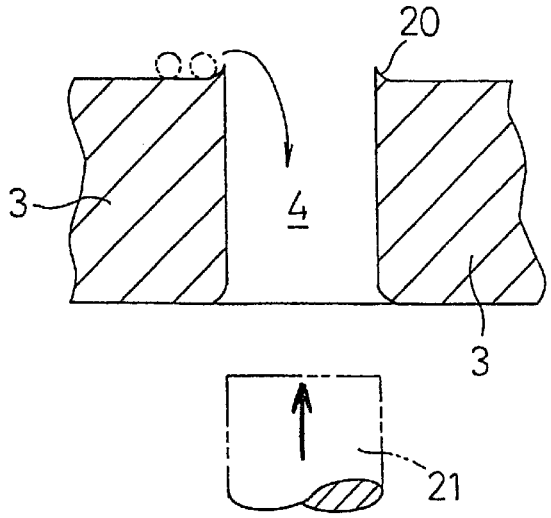
FIG. 9 is a vertical cross-section showing yet another example of the structure of a toner passage hole in this embodiment.

As an alternative, minute protuberances may be formed around the peripheral edge of the toner passage holes 4 on the side of the toner carrier 1 as shown in FIG. 9. Such protuberances 20 will prevent toner 2 deposited around the toner passage holes 4 from falling into the holes and thus prevent clogging of toner in the holes. The proturberances 20 may be formed simply by press-forming the holes 4 using a punch 21 as shown in FIG. 9 from the side opposite from the toner carrier 1, thereby forming burrs on the upper face of the toner passage controller 3 around the holes, because the base material of the toner passage controller 3 is composed of a material having relatively high ductility such as polyimide resin.

Figure 10:
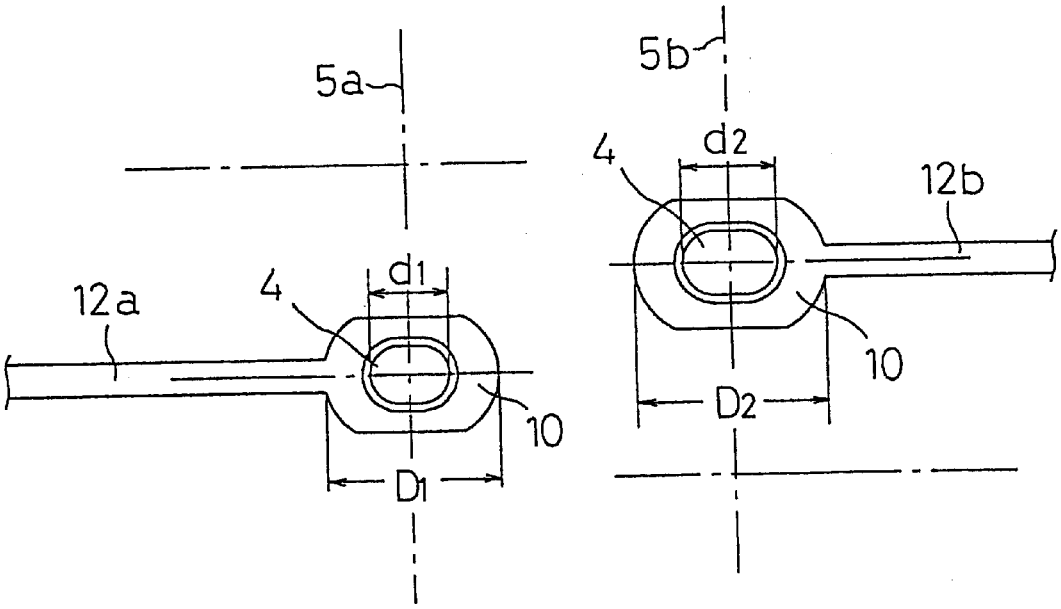
FIG. 10 is a top view showing yet another example of the structure of the toner passage hole and electrodes in this embodiment.
Figure 11:
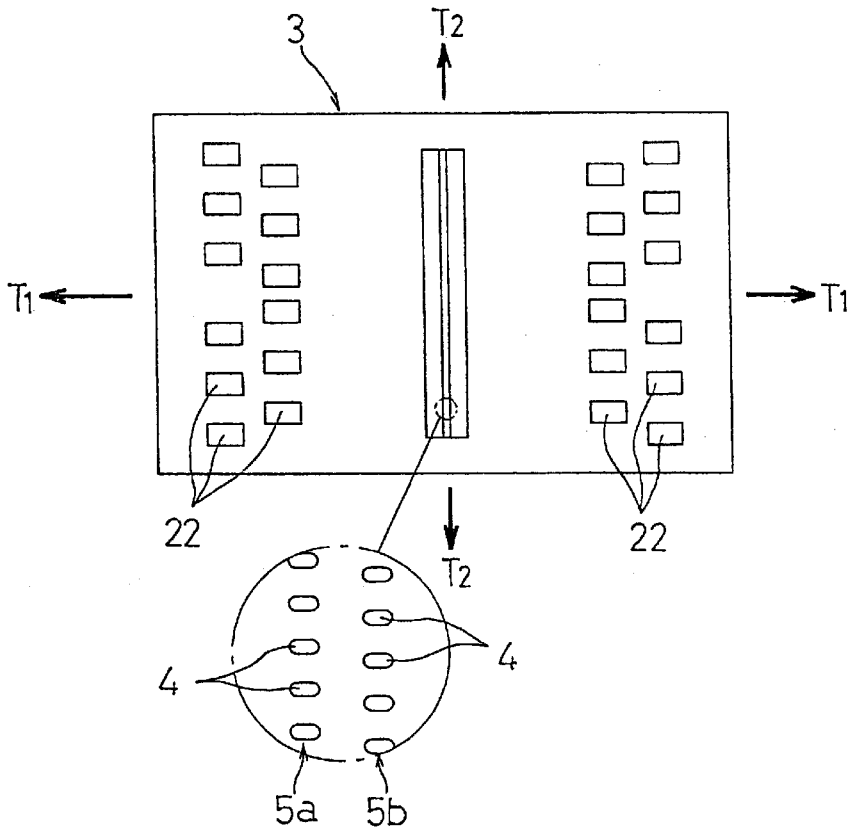
FIG. 11 is a top view of a toner passage controller in this embodiment.

Toner tends to decrease in amount when applied through the holes 4 of the row 5*b* on the downstream side in the moving direction of the toner carrier 1 after being applied thorugh the holes of the upstreamside row 5*a* as mentioned above. In order to compensate for this imbalance in the toner amount, the dimentions of the toner passage holes 4 and their respective control electrodes 10 are varied from the upstream side row 5*a* to the downstream side row 5*b* as shown in FIG. 10. Specifically, $d_1 \leqq d_2$ and $D_1 \leqq D_2$, where $d_1$ is the longer diameter of the toner passage holes 4 of the upstream side row 5*a,* $D_1$ is the longer diameter of the control electrodes 10 for the holes 4, $d_2$ is the longer diameter of the toner passage holes 4 of the downstream side row 5*b,* and $D_2$ is the longer diameter of the control electrodes 10 for the holes 4. In this way, the amount of toner supplied through the downstream side row 5*b* of the holes 4 is increased, whereby the overall toner density is made uniform, and image quality improved.

The toner passage controller 3 is made of a flexible printed board as mentioned above. As shown in the top plan view thereof in FIG. 11, a large number of driving ICs 22 are provided on the opposite ends of the toner passage controller 3 for applying voltage to the control electrodes 10 and the deflection electrodes 11*a,* 11*b* around the toner passage holes 4. The flexible printed board is mounted under a predetermined tension within an image forming head 23 on a frame 24 shown in FIG. 12. The tension given to the flexible printed board is appropriately set such that tention $T_1$ in the moving direction of the toner carrier 1 is smaller than tension $T_2$, so that the tensile force does not cause the elliptic toner passage holes 4 to deform. Thereby, the above-described specific dimensions or area ratio of the toner passage holes 4 is maintained for ensuring high image quality.

Figure 12:
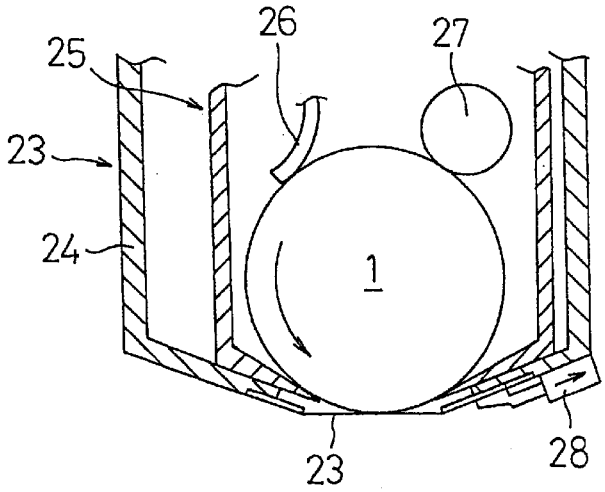
FIG. 12 is a vertical cross-sectional elevation showing a toner supply unit in this embodiment.

In FIG. 12, reference numeral 25 denotes a toner supply unit detachably mounted into the frame 24 of the image forming head 23. The toner carrier 1 is accommodated within the toner supply unit 25 such that part thereof is exposed to the outside and opposed in close proximity to the toner passage controller 3. Toner is applied on the toner carrier 1 in one to three layers as being triboelectrified by a control blade 26. Reference numeral 27 denotes a supply roller for charging and supplying toner to the toner carrier 1. Reference numeral 28 denotes means for applying the above-mentioned tensile force to the flexible printed board.

Next, an image forming device according to another embodiment of the present invention will be described with reference to FIGS. 13 to 15. The image forming device is basically constructed the same as that of the first embodiment described above, and therefore only the differences and characteristic features of this embodiment will be described.

The toner passage controller of this embodiment likewise has an upstream side row 5*a* of toner passage holes 4 and a downstream side row 5*b* of toner passage holes 4, and the connection electrodes 12 for connecting the control electrodes 10 of the upstream side row 5*a* of the holes 4 to their driving ICs extend toward the upstream side in the moving direction of the toner carrier 1, while the connection electrodes 12*b* for connecting the control electrodes 10 of the downstream side row 5*b* of the holes 4 to their driving ICs extend toward the downstream side. The deflection electrodes 11*a* located on the same side of the upstreamside and downstream side holes 4 are mutually connected, and the connection electrodes 13 for connecting the deflection electrodes 11*a* to their driving ICs extend to the upstreamside. Likewise, the deflection electrodes 11*b* located on the other side of the tonner passage holes 4 are mutually connected, and the connection electrodes 13*b* for connecting the deflection electrodes 11*b* to the driving ICs extend toward the downstream side (see FIG. 4B).

Figure 13A:
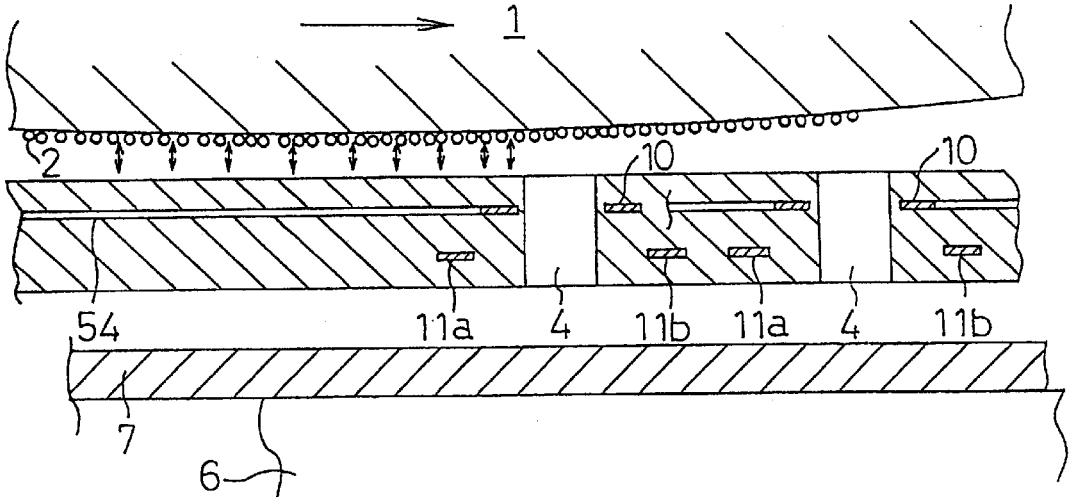
FIG. 13A is a vertical cross-section.
Figure 13B:
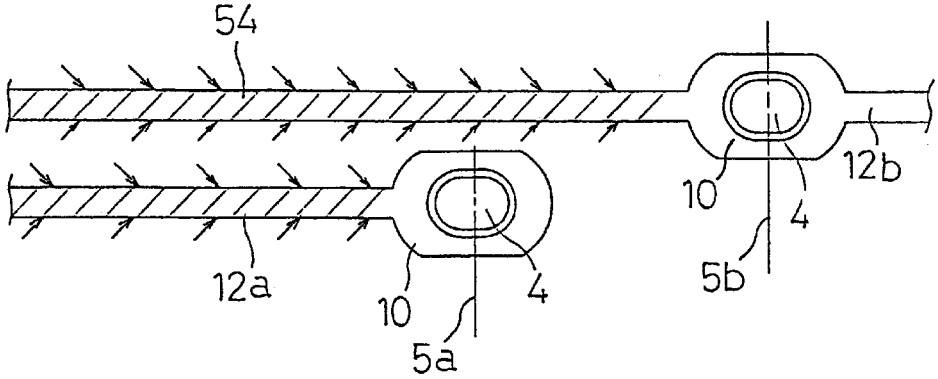
FIG. 13B is a top view, showing the operation of the connection electrodes and dummy electrodes in an image forming device according to another embodiment of the invention.

With respect to the toner passage holes 4 in the upstream side row 5*b,* dummy electrodes 54 are provided such as to extend from the control electrodes 10 toward the upstream side in parallel to the connection electrodes 12*a,* as shown in FIG. 13B.

Since the connection electrodes 12*a,* 12*b* for the control electrodes 10 of the two rows 5*a* and 5*b* extend toward the upstream side and the downstream side, respectively, the driving ICs for the control electrodes 10 and the connection electrodes 12*a,* 12*b* can be divided into two groups and arranged on the upstream side and the downstream side with enough space.

Repeated voltage application to the control electrodes 10 causes toner 2 to fly to and from the toner passage controller above the connection electrodes 12*a* and the dummy electrodes 54 before reaching the toner passage holes 4 as illustrated by the arrows in FIG. 13A, due to the electric fields created by the connection electrodes 12*a* and the dummy electrodes 54 both extending toward the upstream side. Thereby, toner is gathered to both sides above the connection electrodes 12*a* and the dummy electrodes 54 as indicated by the arrows in FIG. 13B, making the toner density uniform, so that toner is efficiently and uniformly supplied from the toner carrier 1 to the toner passage holes 4.

The dummy electrodes 54 extending from the control electrodes 10 of the downstream side row 5*b* of toner passage holes 4 also help make the toner amount passing through the toner passage holes 4 of both rows 5*a* and 5*b* uniform, whereby the problem of white line noise is eliminated.

Figure 14:
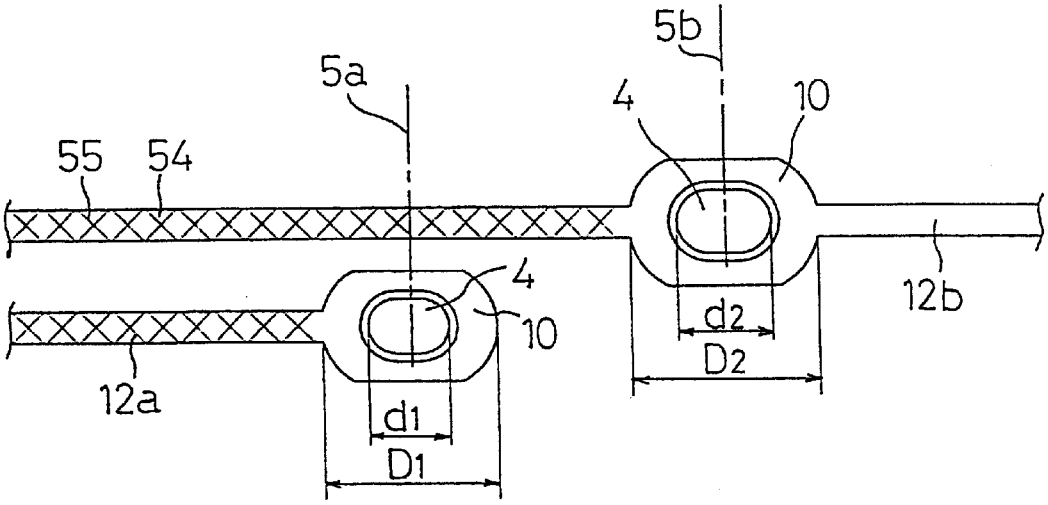
FIG. 14 is a top view of another example of the structure of the connection electrodes and the dummy electrodes in this embodiment.

The dimentions of the toner passage holes 4 and their respective control electrodes 10 of the upstream side row 5*a* and the downstream side row 5*b* may be set as shown in FIG. 14. Specifically, $d_1<d_2$ and $D_1<D_2$, where $d_1$ is the longer diameter of the toner passage holes 4 of the upstream side row 5*a*, $D_1$ is the longer diameter of the control electrodes 10 for the holes 4, $d_2$ is the longer diameter of the toner passage holes 4 of the downstream side row 5*b*, and $D_2$ is the longer diameter of the control electrodes 10 for the holes 4. In this way, the amount of toner supplied through the downstream side row 5*b* of the holes 4 is increased, whereby the overall toner density is made uniform, and image quality improved.

The connection electrodes 12*a* and dummy electrodes 54 on the upstream side of the holes 4 in the moving direction of the toner carrier 1 may have a roughened surface 55, so as to activate the motion of the toner 2 on the upstream side of the toner passage holes 4 by the action of electric fields concentrating on these electrodes. Thereby, agglomeration and dispersion of the toner 2 are repeated, so that the toner is more densely and uniformly distributed.

Figure 15:
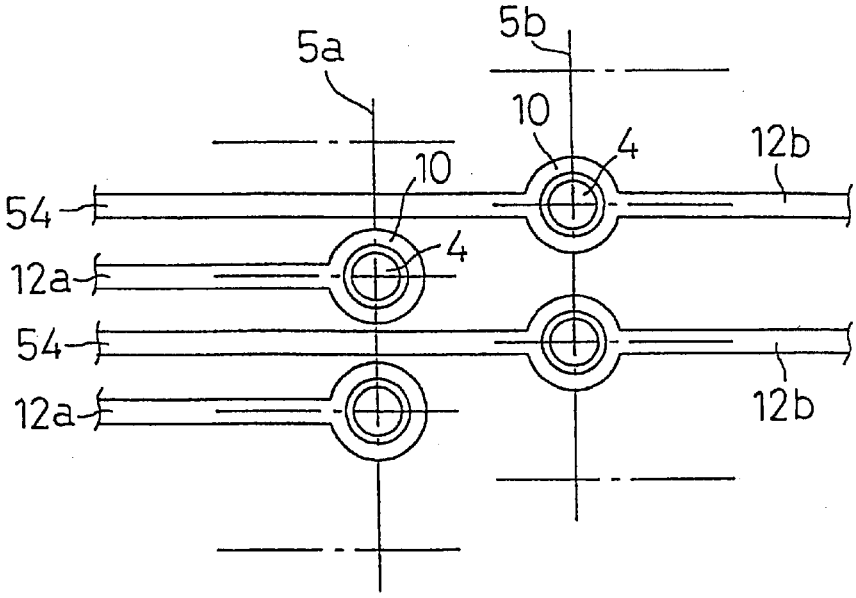
FIG. 15 is a top view showing the arrangement of the electrodes in an image forming device according to yet another embodiment of the invention.

The toner passage holes 4 may be formed circular and the control electrodes 10 may be annular, as shown in FIG. 15. The same effects will be achieved by providing dummy electrodes extending from the control electrodes 10 of the downstream side row 5*b* toward the upstream side.

Whether the toner passage holes 4 are provided in a single row or a plurality of rows, the connection electrodes for connecting control electrodes 10 to their driving ICs may all be extended toward the upstream side. Alternatively, the connection electrodes may all be extended toward the downstream side in the moving direction of the toner carrier 1, if dummy electrodes 54 are provided to the control electrodes 10 to extend toward the upstream side. Also, the connection electrodes 12*a*, 12*b* need not be extended alternately toward the upstream side and the downstream side, but instead may be divided into a plurality of groups, and these groups of connection electrodes may be arranged to extend alternately in opposite directions. In this case also, same effects will be achieved by providing dummy electrodes 54 extending toward the upstream side to the control electrodes 10 on the downstream side.

Next, an image forming device according to yet another embodiment of the present invention will be described with reference to FIG. 16. The image forming device is basically constructed the same as that of the first embodiment described above, and therefore only the differences and characteristic features of this embodiment will be described.

Figure 16A:
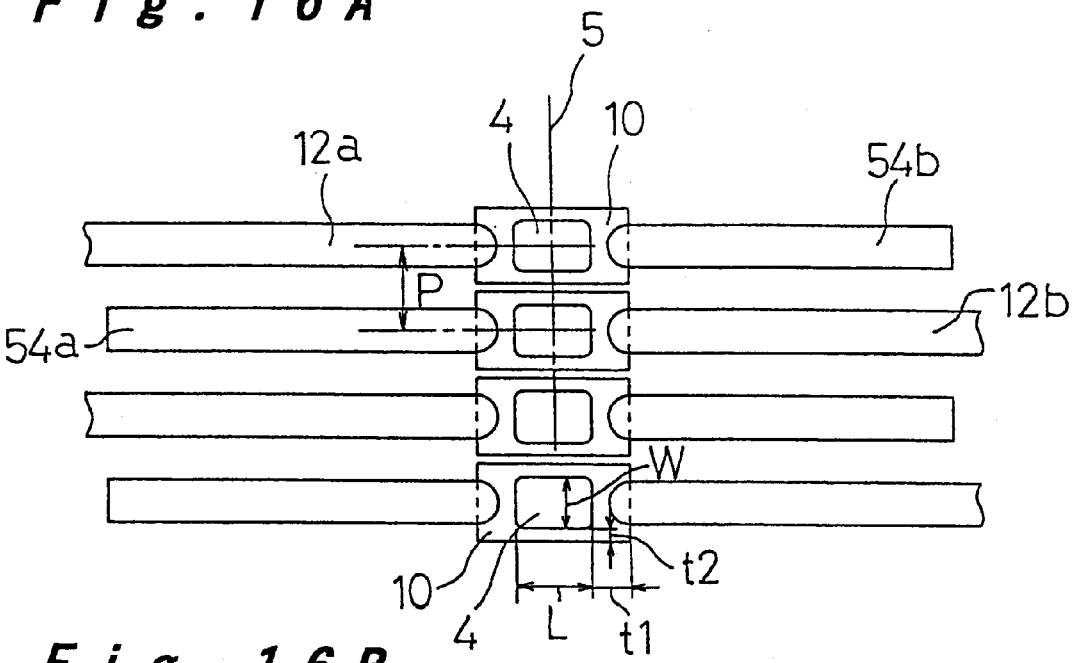
FIGS. 16A and 16B are top plan views showing the arrangement of the electrodes and deflection electrodes, respectively, in an image forming device according to another embodiment of the invention.

The toner passage holes 4 in this embodiment are formed in a rectangular shape with rounded corners having a length L in the moving direction of the toner carrier 1 larger than the width W in the direction perpendicular thereto, as shown in FIG. 16A.

Figure 16B:
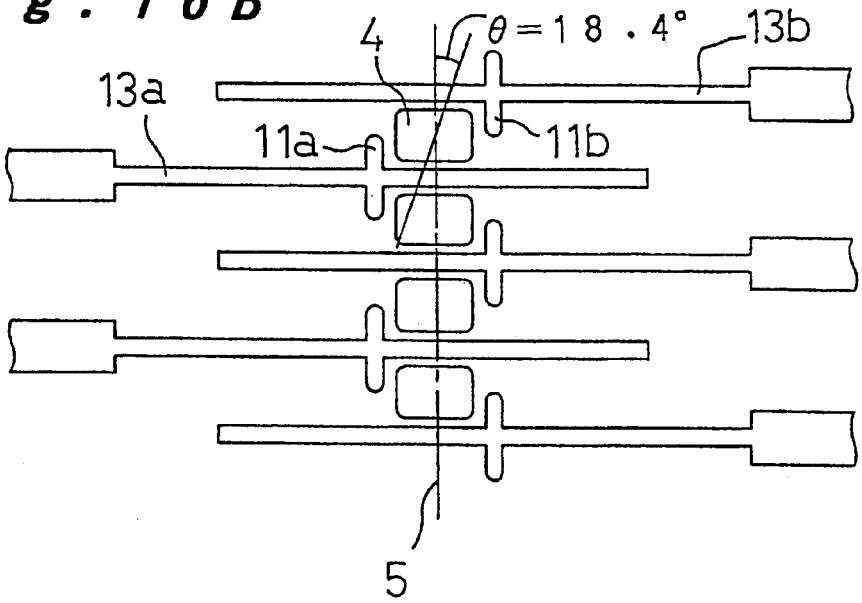
Figure 17:
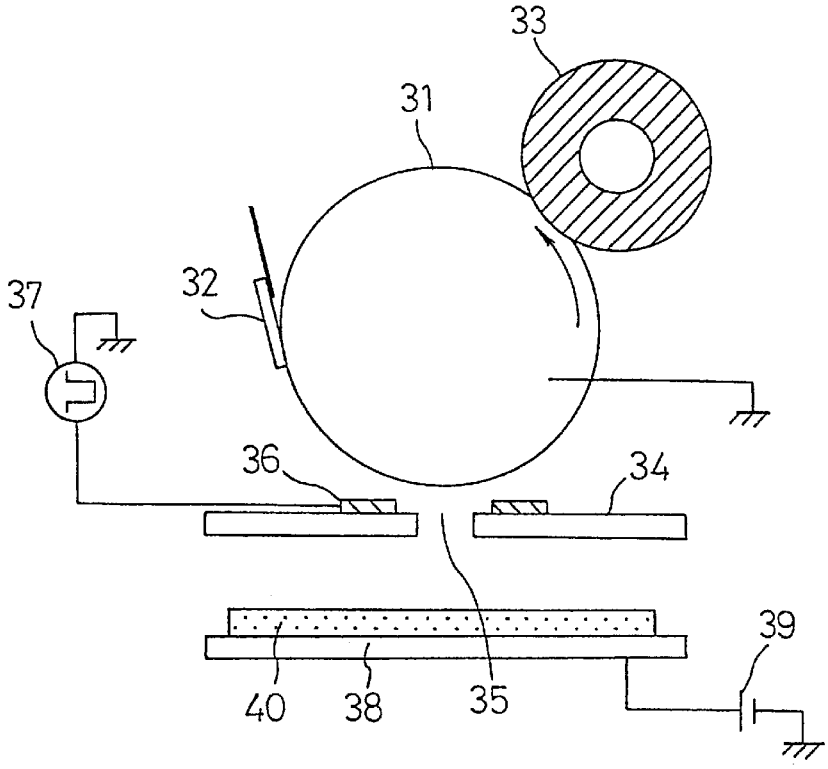
Fig. 17 Prior Art
FIG. 17 is a diagram illustrating the basic configuration of a conventional image forming device.
Figure 18:
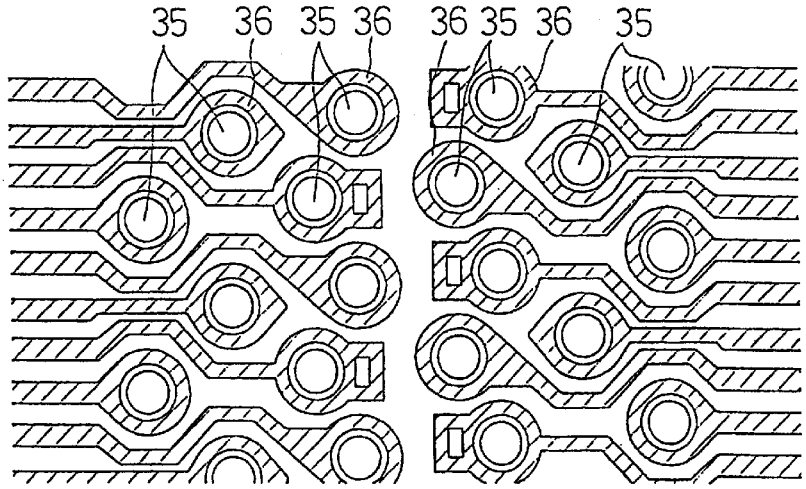
Fig. 18 Prior Art
FIG. 18 is a top view showing the arrangement of the toner passage holes and the electro des in the conventional example.
Figure 19A:
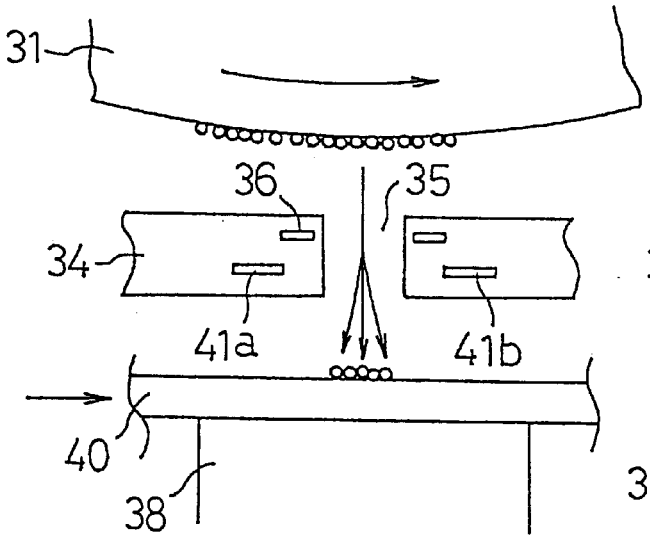
Prior Art Fig. 19A
FIG. 19A is a vertical cross-sectional front elevation and FIG. 19B is a vertical cross-sectional side elevation, illustrating various operating states in a toner passage hole in another conventional example.
Figure 19B:
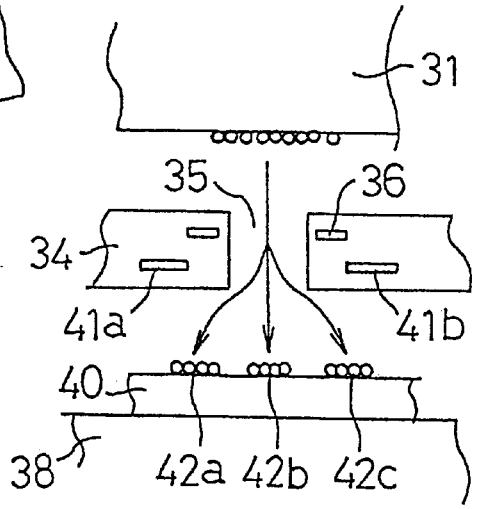
Figure 20A:
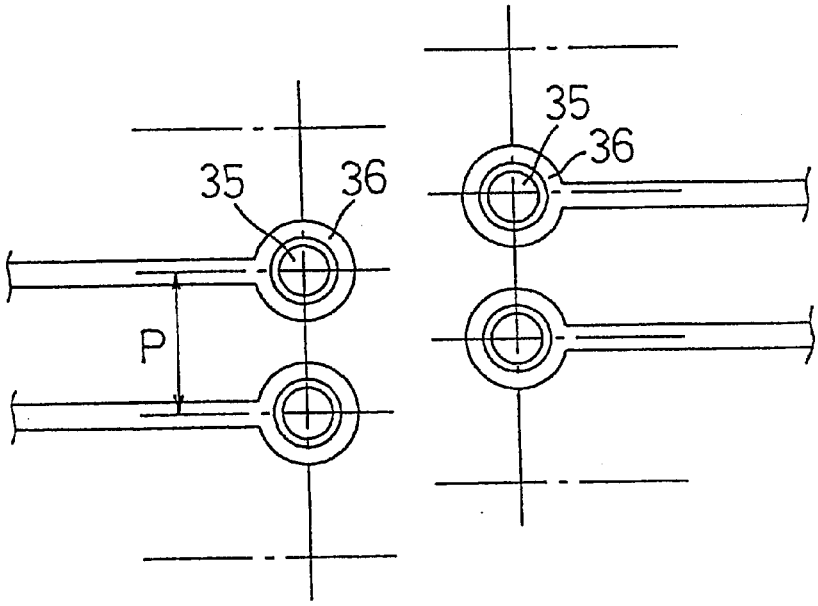
Prior Art Fig. 20A
FIGS. 20A and 20B are top plan views showing the arrangement of the electrodes and deflection electrodes in the conventional example.
Figure 20B:
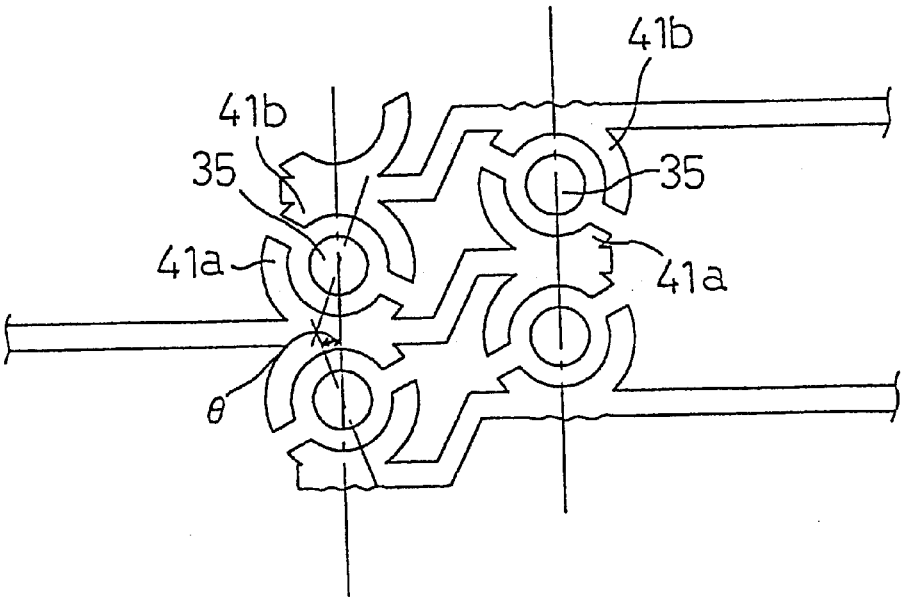
Figure 21:
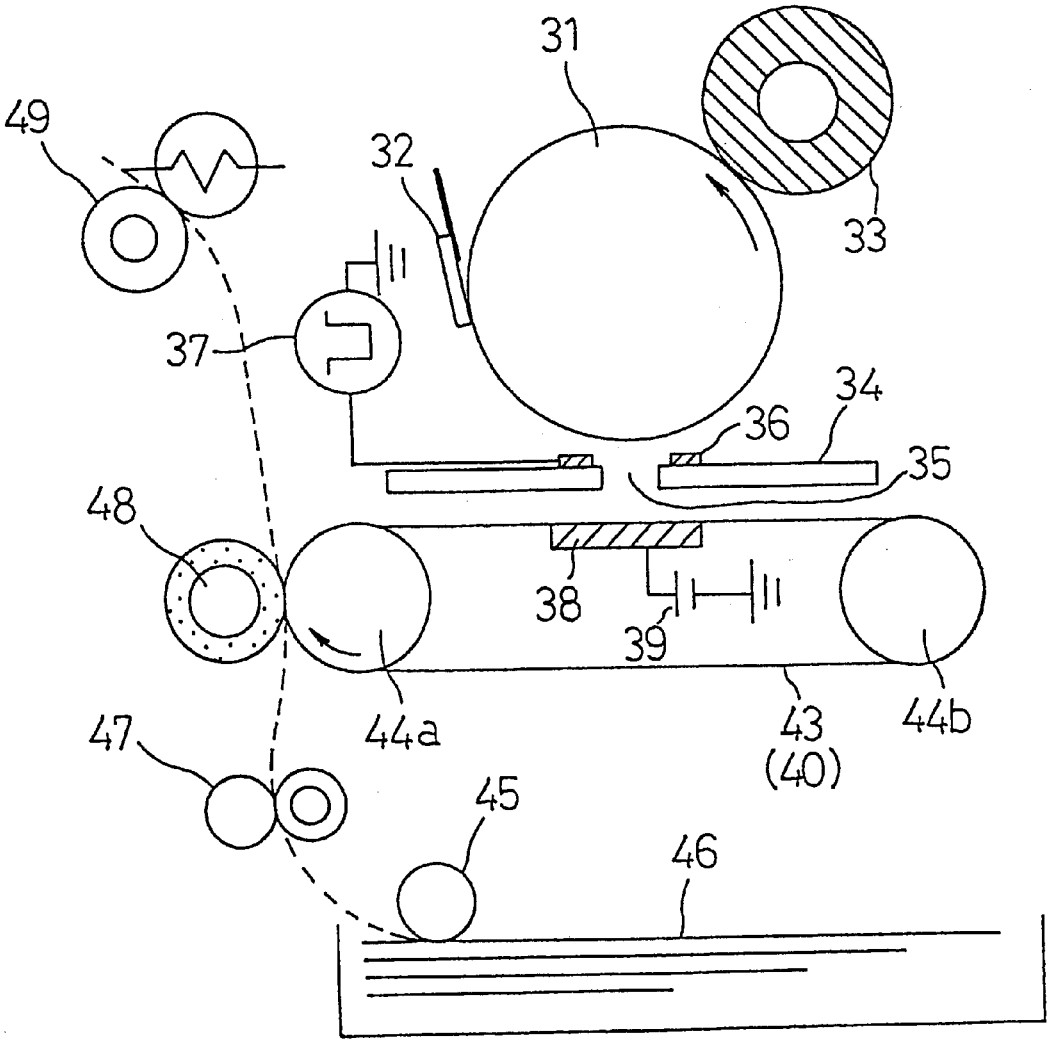
Fig. 21 Prior Art
FIG. 21 is a diagram showing the entire configuration of yet another conventional image forming device.

The control electrodes 10 surronding the toner passage holes 4 are also formed rectangular in conformity to the planar shape of the toner passage holes 4. Their width $t_1$ in a direction along the longer side of the toner passage holes 4 is larger than the width $t_2$ in a direction along the shorter side of the holes. Deflection electrodes 11*a*, 11*b* are arranged to be L-shaped on both sides of the toner passage holes 4 such that the angle defined by the line through their effective centers and the line through the centers of the rows 5 of toner passage holes 4 is $\tan\theta/3$, that is, 18.4. The deflection electrodes 11*a*, 11*b* are shared by neighboring toner passage holes 4, and therefore they are actually formed to have longitudinal electrodes extending in the moving direction of the toner carrier 1 and lateral electrodes provided in T-shape at positions alternately on the upstream side and the downstream side of the toner passage holes 4 as shown in FIG. 16B.

The control electrodes 10 and their driving ICs are connected by connection electrodes 12*a*, 12*b* extending in alternation toward the upstream side and the downstream side with respect to the moving direction of the toner carrier 1, as shown in FIG. 16A. The deflection electrodes 11*a*, 11*b* and their driving ICs are connected by connection electrodes 13*a* and 13*b* extending toward the upstream side or the downstream side from the center of the T-shaped lateral electrodes in directions opposite from the longitudinal electrodes.

In addition, dummy electrodes 54*a* and 54*b* of suitable length extend toward the upstream side and the downstream side from the control electrodes 10 in directions opposite from the respective connection electrodes 12*a*, 12*b*. The dummy electrodes have a length determined by their effects on toner 2 held on the toner carrier 1 by the electric fields created thereby. The longitudinal electrodes of the deflection electrodes 11*a*, 11*b* have a length considerably larger than that of the toner passage holes 4. Preferably, the connection electrodes 12*a*, the dummy electrodes 54*a*, and the control electrodes 10 have a roughened surface on the upstream side of the toner passage holes 4 with respect to the moving direction of the toner carrier 1.

According to this embodiment, the toner passage holes 4 are arranged in one row, while toner is caused to be deposited on a plurality of points through a single toner passage hole 4 by means of the deflection electrodes 11*a*, 11*b*. Accordingly, the toner passage holes 4 are arranged with a practicable pitch space of 127 $\mu$m, enabling a fine image of 600 dpi to be formed. The single row arrangement of toner passage holes 4 makes toner supply under constant conditions possible, whereby image quality is enhanced. In view of the elongated shape of the toner passage holes 4 having a length L larger than the width W, the toner consumption areas on the toner carrier 1 corresponding to each of the toner passage holes 4 hardly interfere with each other, despite the smaller pitch space of 127 $\mu$m. The large length dimension L of the toner passage holes 4 secures sufficient open area of the holes and prevents toner clogging.

INDUSTRIAL APPLICABILITY

The image forming device of the invention enables the problem of white line noise to be eliminated and the toner clogging in toner passage holes to be prevented, and therefore offers high processing performance and image quality.

What is claimed is:

1. An image forming device comprising:

a toner carrier for holding and conveying charged toner;

a toner passage controller including a plurality of holes through which toner is passed and a plurality of control electrodes surrounding the holes, control of passing of the toner through the holes being effected by applying voltage to the control electrodes in accordance with input image signals;

an image receiving member on which toner is deposited; and a backside electrode for attracting toner thereto disposed on the backside of the image receiving member, wherein the holes are formed in an elongated shape, with a length thereof along a direction in which the toner carrier moves being larger than a width thereof along a direction orthogonal to the lengthwise direction.

2. The image forming device according to claim 1 wherein the holes are formed in an elliptic shape.

3. The image forming device according to claim 1 wherein $0.65 \leqq W/L \leqq 0.90$ where L is a length of the holes in a direction in which the toner carrier moves, and W is a width in a direction orthogonal to the lengthwise direction.

4. The image forming device according to claim 3 wherein $5000\ \mu m^2 \leqq S \leqq 7000\ \mu m^2$ $W \geqq 70\ \mu m$ where S is an open area of the holes.

5. An image forming device comprising:

a toner carrier for holding and conveying charged toner;

a toner passage controller including a plurality of holes through which toner is passed and a plurality of control electrodes surrounding the holes, control of passing of the toner through the holes being effected by applying voltage to the control electrodes in accordance with input image signals;

an image receiving member on which toner is deposited; and a backside electrode for attracting toner thereto disposed on the backside of the image receiving member, wherein the holes have a minimum radius of curvature at a corner thereof which is larger than a mean particle size of the toner.

6. An image forming device comprising:

a toner carrier for holding and conveying charged toner;

a toner passage controller including a plurality of holes through which toner is passed and a plurality of control electrodes surrounding the holes, control of passing of the toner through the holes being effected by applying voltage to the control electrodes in accordance with input image signals;

an image receiving member on which toner is deposited; and a backside electrode for attracting toner thereto disposed on the backside of the image receiving member, wherein an inner wall surface of the holes has a surface roughness lower than a mean particle size of an additive added to the toner.

7. An image forming device comprising:

a toner carrier for holding and conveying charged toner;

a toner passage controller including a plurality of holes through which toner is passed and a plurality of control electrodes surrounding the holes, control of passing of the toner through the holes being effected by applying voltage to the control electrodes in accordance with input image signals;

an image receiving member on which toner is deposited; and a backside electrode for attracting toner thereto disposed on the backside of the image receiving member, wherein the holes are formed with an inner wall surface made of a material having low affinity with the toner.

8. An image forming device comprising:

a toner carrier for holding and conveying charged toner;

a toner passage controller including a plurality of holes through which toner is passed and a plurality of control electrodes surrounding the holes, control of passing of the toner through the holes being effected by applying voltage to the control electrodes in accordance with input image signals;

an image receiving member on which toner is deposited; and a backside electrode for attracting toner thereto disposed on the backside of the image receiving member, wherein the holes have an inner wall surface coated with a material having low affinity with the toner and a melting point lower than that of a material forming the toner passage controller.

9. An image forming device comprising:

a toner carrier for holding and conveying charged toner;

a toner passage controller including a plurality of holes through which toner is passed and a plurality of control electrodes surrounding the holes, control of passing of the toner through the holes being effected by applying voltage to the control electrodes in accordance with input image signals;

an image receiving member on which toner is deposited; and a backside electrode for attracting toner thereto disposed on the backside of the image receiving member, wherein the holes are provided with minute projections at the peripheral edge thereof on a surface opposite the toner carrier.

10. An image forming device comprising:

a toner carrier for holding and conveying charged toner;

a toner passage controller including a plurality of holes through which toner is passed and a plurality of control electrodes surrounding the holes, control of passing of the toner through the holes being effected by applying voltage to the control electrodes in accordance with input image signals;

an image receiving member on which toner is deposited; and a backside electrode for attracting toner thereto disposed on the backside of the image receiving member, wherein the holes are provided with minute projections at the peripheral edge thereof on a surface opposite the toner carrier, said micro projections being burrs created when punching out the holes.

11. An image forming device comprising:

a toner carrier for holding and conveying charged toner;

a toner passage controller including a plurality of holes through which toner is passed and a plurality of control electrodes surrounding the holes, control of passing of the toner through the holes being effected by applying voltage to the control electrodes in accordance with input image signals;

an image receiving member on which toner is deposited; and a backside electrode for attracting toner thereto disposed on the backside of the image receiving member, wherein the holes are formed in an elongated shape, with a length thereof along a direction in which the toner carrier moves being larger than a width thereof along a direction orthogonal to the lengthwise direction, and wherein the toner passage controller is given larger tension in the moving direction of the toner carrier than in the direction orthogonal thereto.

12. An image forming device comprising:

a toner carrier for holding and conveying charged toner;

a toner passage controller including a plurality of holes through which toner is passed and a plurality of control electrodes surrounding the holes, control of passing of the toner through the holes being effected by applying voltage to the control electrodes in accordance with input image signals;

an image receiving member on which toner is deposited; and a backside electrode for attracting toner thereto disposed on the backside of the image receiving member, wherein the holes are formed in an elongated shape, with a length thereof along a direction in which the toner carrier moves being larger than a width thereof along a direction orthogonal to the lengthwise direction, and wherein the control electrodes surrounding the holes have a larger width in a direction along a longer diameter of the holes than a width thereof in a direction along a shorter diameter of the holes.

13. An image forming device comprising:

a toner carrier for holding and conveying charged toner;

a toner passage controller including a plurality of holes through which toner is passed and a plurality of control electrodes surrounding the holes, control of passing of the toner through the holes being effected by applying voltage to the control electrodes in accordance with input image signals;

an image receiving member on which toner is deposited; and a backside electrode for attracting toner thereto disposed on the backside of the image receiving member, wherein the control electrodes have a rough surface in a portion upstream of the holes in a direction in which the toner carrier moves.

14. An image forming device comprising:

a toner carrier for holding and conveying charged toner;

a toner passage controller including a plurality of holes through which toner is passed and a plurality of control electrodes surrounding the holes, control of passing of the toner through the holes being effected by applying voltage to the control electrodes in accordance with input image signals;

an image receiving member on which toner is deposited; and a backside electrode for attracting toner thereto disposed on the backside of the image receiving member, wherein the holes are formed in a plurality of rows with a certain pitch space along a direction orthogonal to a direction in which the toner carrier moves, the holes and the control electrodes on a downstream side in the moving direction of the toner carrier having a diameter larger than that of the holes and the control electrodes on an upstream side.

15. An image forming device comprising:

a toner carrier for holding and conveying charged toner;

a toner passage controller including a plurality of holes through which toner is passed and a plurality of control electrodes surrounding the holes, control of passing of the toner through the holes being effected by applying voltage to the control electrodes in accordance with input image signals, the plurality of holes being arranged along a direction orthogonal to a direction in which the toner carrier moves in two rows on an upstream side and a downstream side in the moving direction of the toner carrier, the two rows being offset from each other so that the holes are arranged in a zigzag fashion;

a plurality of connection electrodes respectively connected to each of the control electrodes for applying voltage thereto in accordance with the image signals, one group of connection electrodes connected to the control electrodes surrounding the holes of one row on the upstream side extending toward upstream side, while the other group of connection electrodes connected to the control electrodes surrounding the holes of the other row on the downstream side extending toward downstream side;

a plurality of dummy electrodes respectively connected to each of the control electrodes surrounding the holes of the row on the downstream side such as to extend toward upstream side;

an image receiving member on which toner is deposited; and a backside electrode for attracting toner thereto disposed on the backside of the image receiving member.

16. An image forming device comprising:

a toner carrier for holding and conveying charged toner;

a toner passage controller including a plurality of holes through which toner is passed and a plurality of control electrodes surrounding the holes, control of passing of the toner through the holes being effected by applying voltage to the control electrodes in accordance with input image signals, the plurality of holes being arranged along a direction orthogonal to a direction in which the toner carrier moves in a single or a plurality of rows;

a plurality of electrodes respectively connected to each of the control electrodes and extending toward an upstream side in the moving direction of the toner carrier;

an image receiving member on which toner is deposited; and a backside electrode for attracting toner thereto disposed on the backside of the image receiving member.

17. An image forming device comprising:

a toner carrier for holding and conveying charged toner;

a toner passage controller including a plurality of holes through which toner is passed and a plurality of control electrodes surrounding the holes, control of passing of the toner through the holes being effected by applying voltage to the control electrodes in accordance with input image signals, the plurality of holes being arranged along a direction orthogonal to a direction in which the toner carrier moves in a single or a plurality of rows;

a plurality of connection electrodes respectively connected to each of the control electrodes for applying voltage thereto in accordance with the image signals and extending alternately toward an upstream side and a downstream side in the moving direction of the toner carrier;

a plurality of dummy electrodes respectively connected to the control electrodes from which the connection electrodes extend toward the downstream side and extending toward the upstream side;

an image receiving member on which toner is deposited; and a backside electrode for attracting toner thereto disposed on the backside of the image receiving member.

18. The image forming device according to any one of claims 15 to 17, wherein the electrodes extending from the control electrodes toward the upstream side of the toner carrier have a rough surface.

19. An image forming device comprising:

a toner carrier for holding and conveying charged toner;

a toner passage controller including a plurality of holes through which toner is passed and a plurality of control electrodes surrounding the holes, control of passing of the toner through the holes being effected by applying voltage to the control electrodes in accordance with input image signals, the plurality of holes and the control electrodes being formed in one row with a certain pitch space along a direction orthogonal to a direction in which the toner carrier moves;

a plurality of deflection electrodes provided on both sides of each one of the holes in the direction orthogonal to the moving direction of the toner carrier;

an image receiving member on which toner is deposited; and a backside electrode for attracting toner thereto disposed on the backside of the image receiving member.

20. An image forming device comprising:

a toner carrier for holding and conveying charged toner;

a toner passage controller including a plurality of holes through which toner is passed and a plurality of control electrodes surrounding the holes, control of passing of the toner through the holes being effected by applying voltage to the control electrodes in accordance with input image signals, the plurality of holes being arranged along a direction orthogonal to a direction in which the toner carrier moves; and a plurality of deflection electrodes including longitudinal electrodes extending along the moving direction of the toner carrier and lateral electrodes extending perpendicular thereto from both sides of the longitudinal electrodes alternately at positions on an upstream side and a downstream side of each of the holes, so that one lateral electrode is shared by two adjacent holes;

an image receiving member on which toner is deposited; and a backside electrode for attracting toner thereto disposed on the backside of the image receiving member.

* * * * *